US009797142B1

(12) United States Patent
Sacks et al.

(10) Patent No.: US 9,797,142 B1
(45) Date of Patent: Oct. 24, 2017

(54) LATH DEVICE, ASSEMBLY AND METHOD

(71) Applicant: Sacks Industrial Corporation, Vancouver (CA)

(72) Inventors: Abraham Jacob Sacks, Vancouver (CA); William Spilchen, Surrey (CA); Jeffrey Sacks, Vancouver (CA); Matthew Alan Bell, Vancouver (CA)

(73) Assignee: Sacks Industrial Corporation, Vancouver (CA)

( * ) Notice: Subject to any disclaimer, the term of this patent is extended or adjusted under 35 U.S.C. 154(b) by 0 days.

(21) Appl. No.: 15/261,821

(22) Filed: Sep. 9, 2016

(51) Int. Cl.
*E04F 13/04* (2006.01)
*E04C 2/42* (2006.01)
*E04C 2/08* (2006.01)

(52) U.S. Cl.
CPC ..... *E04F 13/04* (2013.01); *E04C 2/08* (2013.01); *E04C 2/42* (2013.01)

(58) Field of Classification Search
CPC ..... E04F 13/04; E04F 13/047; E04F 13/045; E04C 2/08; E04C 2/42
USPC ..... 52/660, 664, 666, 669, 344, 386, 443, 52/454, 670, 673, 674
See application file for complete search history.

(56) References Cited

U.S. PATENT DOCUMENTS 320,163 A 6/1885 Orr
528,931 A 11/1894 Eils
553,306 A * 1/1896 Fordyce ..... E04C 2/423 245/8
600,352 A 3/1898 Bell
617,458 A 1/1899 Clancy
651,590 A 6/1900 Brightman
(Continued)

FOREIGN PATENT DOCUMENTS

CA 2 391 269 A1 1/2003
CA 2 652 919 A1 5/2010
(Continued)

OTHER PUBLICATIONS

"Decorative Patterns Portfolio," retrieved from http://www.expac.com/decorative_patterns.htm, retrieved on, May 6, 2014, 2 pages.
(Continued)

*Primary Examiner* — Brian Glessner
*Assistant Examiner* — Adam Barlow
(74) *Attorney, Agent, or Firm* — Seed IP Law Group LLP

(57) ABSTRACT

The present invention provides for a welded wire lath device having a plurality of longitudinal wires extending along a plane and in a longitudinal direction, a plurality of tension release devices disposed on the plurality of longitudinal wires, a plurality of transverse wires extending along the plane in a transverse direction; and a plurality of weld connections at each intersection point between the plurality of longitudinal wires and the plurality of transverse wires. Each of the plurality of tension release devices are randomly spaced along the plurality of parallel longitudinal wires. The longitudinal wires, including each of the plurality of tension release devices, have a rectilinear cross-section. The present invention also provides for a structural assembly, and related method, having the welded wire lath device attached to a structural support such as a wall or ceiling and having a cementitious material embedded within the welded wire lath device.

28 Claims, 11 Drawing Sheets

(56) References Cited

U.S. PATENT DOCUMENTS 659,416 A 10/1900 Perry
D35,386 S 12/1901 Reid
749,714 A 1/1904 Barnes et al.
792,039 A 6/1905 Hollinger
930,350 A 8/1909 Clark
934,081 A 9/1909 Marks
945,656 A 1/1910 White
948,414 A 2/1910 Clark
987,374 A 3/1911 Kahn
1,059,710 A 4/1913 Chess, Jr.
1,087,511 A 2/1914 Scammell
1,112,649 A 10/1914 Parr
1,146,999 A 7/1915 Burk
1,147,000 A 7/1915 Burk
1,276,764 A 8/1918 Holbrook, Sr.
1,314,777 A 9/1919 White
1,363,018 A 12/1920 Sexton
1,372,741 A 3/1921 Dickinson
1,405,579 A 2/1922 Graham
1,419,709 A 6/1922 Ackermann
1,434,915 A 11/1922 Scholfield
1,436,866 A 11/1922 Dickinson
1,537,588 A 5/1925 Curtis
1,591,858 A 7/1926 McClintic
1,637,410 A 8/1927 Coryell
1,641,872 A 9/1927 Southwell
1,655,091 A 1/1928 Curtis
1,691,227 A 11/1928 Cross
1,701,125 A 2/1929 Sagendorph
1,704,608 A 3/1929 Humphris
1,743,800 A 1/1930 Pearce
1,767,814 A 6/1930 Reynolds
1,769,361 A 7/1930 Warren
1,801,530 A 4/1931 Overmire
1,802,779 A 4/1931 Quade
1,824,082 A 9/1931 Hernandez
1,837,393 A 12/1931 Arey
1,885,343 A 11/1932 Greulich
1,897,842 A 2/1933 Herbest, Jr.
1,963,395 A 6/1934 Zabriskie
1,964,403 A 6/1934 Loucks
1,976,395 A 10/1934 Herbest, Jr.
1,986,171 A 1/1935 Wilson
1,986,172 A 1/1935 Wilson
1,993,432 A 3/1935 Boyle
2,022,363 A 11/1935 Vertuno
2,089,023 A 8/1937 Hahn
2,099,709 A 11/1937 Spinosa
2,101,074 A 12/1937 Kotrbaty
2,116,668 A 5/1938 Cross
2,121,962 A 6/1938 Glass
2,131,670 A 9/1938 Redding et al.
2,136,071 A 11/1938 Braden
2,141,400 A 12/1938 Mack
2,150,606 A 3/1939 McLellan
2,180,486 A 11/1939 Tench
2,184,353 A 12/1939 Leary
2,218,007 A 10/1940 Miller
2,219,806 A 10/1940 Buttress
2,236,141 A 3/1941 Karelius
2,241,991 A 5/1941 Goldsmith
2,243,723 A 5/1941 Tench
2,256,394 A 9/1941 Lamel
2,267,401 A 12/1941 Gilmore
2,269,869 A 1/1942 Specht
2,303,737 A * 12/1942 Hampson ..... E04F 13/04 52/448
2,315,687 A 4/1943 Burke
2,322,654 A 6/1943 Moore
2,322,657 A 6/1943 Olsen
2,375,303 A 5/1945 Karelius
2,455,666 A 12/1948 Fournier
2,474,778 A 6/1949 Cross
2,501,699 A 3/1950 Stecker
2,565,292 A 8/1951 Arthur
2,572,483 A 10/1951 Howle
2,595,465 A 5/1952 Keene et al.
2,605,867 A 8/1952 Goodwin
2,621,160 A 12/1952 Johnson et al.
2,639,269 A 5/1953 Dube
2,645,824 A 7/1953 Titsworth
2,645,930 A 7/1953 Stockton
2,650,171 A 8/1953 Schaaf
2,668,606 A 2/1954 King
2,824,022 A 2/1958 Sucetti
2,903,880 A 9/1959 Johnson
2,929,239 A 3/1960 Dahlhauser et al.
2,936,051 A 5/1960 Martin
2,989,145 A * 6/1961 Goodloe ..... B01D 39/12 29/896.62
2,996,160 A 8/1961 Voight
3,070,198 A 12/1962 Haskell
3,073,066 A 1/1963 Edwards et al.
3,097,832 A 7/1963 Murdock et al.
3,145,001 A 8/1964 Bruninga
3,276,096 A 10/1966 McAleer et al.
3,299,785 A 1/1967 James
3,304,680 A 2/1967 Birdwell
3,342,003 A * 9/1967 Frank ..... E04C 5/04 52/645
3,363,371 A 1/1968 Villalobos
3,475,876 A 11/1969 Oroschakoff
3,503,590 A 3/1970 Buysens
3,522,685 A 8/1970 Oroschakoff
3,581,649 A 6/1971 Rauenhorst
3,600,868 A 8/1971 Wilson, Jr. et al.
3,660,215 A 5/1972 Pawlicki
3,672,022 A 6/1972 York
3,757,485 A 9/1973 Vincens
3,769,065 A 10/1973 Dunn
3,789,747 A 2/1974 Wasserman et al.
3,831,333 A 8/1974 Nelsson et al.
3,947,936 A 4/1976 Wheadon
3,954,180 A 5/1976 Montonen et al.
3,991,536 A 11/1976 Rutherford
4,000,241 A 12/1976 Dunn
4,003,178 A 1/1977 Douthwaite
4,011,704 A 3/1977 O'Konski
4,020,612 A 5/1977 Welch
4,056,195 A 11/1977 Keith
4,085,558 A 4/1978 Albrecht
4,099,386 A 7/1978 Sagasta
4,159,302 A 6/1979 Greve et al.
4,179,264 A 12/1979 Vancauwenberghe
4,226,061 A 10/1980 Day, Jr.
4,245,926 A * 1/1981 Asszonyi ..... B21F 27/20 405/146
4,248,022 A 2/1981 Walker
4,253,288 A * 3/1981 Chun ..... E04B 2/845 264/34
4,255,489 A 3/1981 Nielsen
4,297,866 A 11/1981 Sakauye et al.
4,343,127 A 8/1982 Greve et al.
4,347,155 A 8/1982 Jenkins
4,385,476 A 5/1983 Slager
4,396,685 A 8/1983 Jury
4,447,380 A 5/1984 Shannon et al.
4,464,885 A 8/1984 Palacio et al.
4,485,606 A 12/1984 Gottlieb
4,510,727 A 4/1985 Jury
4,512,736 A 4/1985 Wader
4,513,551 A 4/1985 Gauffin et al.
4,520,073 A 5/1985 Randolph et al.
4,522,860 A 6/1985 Scott et al.
4,525,388 A 6/1985 Rehder et al.
4,539,787 A 9/1985 Ritter et al.
4,545,170 A 10/1985 Shirey
4,551,957 A 11/1985 Madray
4,559,749 A 12/1985 Nusbaum
4,559,752 A 12/1985 Kieffer
4,571,914 A 2/1986 Stoyanoff
4,580,379 A 4/1986 Nusbaum
4,621,397 A 11/1986 Schrenk
4,658,552 A 4/1987 Mulford

(56) References Cited

U.S. PATENT DOCUMENTS 4,669,243 A 6/1987 Gore et al.
4,691,493 A 9/1987 Larsen
4,693,048 A 9/1987 Guetersloh
4,695,033 A 9/1987 Imaeda et al.
4,713,921 A 12/1987 Minialoff et al.
4,720,957 A 1/1988 Madray
4,722,861 A 2/1988 Sawaide
4,734,337 A 3/1988 Patton
4,793,113 A 12/1988 Bodnar
4,803,128 A 2/1989 Bender
4,819,395 A 4/1989 Sugita et al.
4,841,705 A 6/1989 Fuhrer
4,843,786 A 7/1989 Walkinshaw et al.
4,893,569 A 1/1990 Hansen
4,897,007 A 1/1990 Chen et al.
4,920,716 A * 5/1990 Coffey ..... E04F 13/04 52/386
4,968,185 A 11/1990 Leibhard et al.
5,002,696 A 3/1991 White
5,027,572 A 7/1991 Purcell et al.
5,029,779 A 7/1991 Bruggeman
5,081,814 A 1/1992 Singletary et al.
5,157,887 A 10/1992 Watterworth, III
5,231,811 A 8/1993 Andrepont et al.
5,249,400 A 10/1993 Turner
5,287,673 A 2/1994 Kreikemeier
5,305,941 A 4/1994 Kent et al.
5,321,928 A 6/1994 Warneke
5,360,771 A 11/1994 Delvaux et al.
5,363,621 A 11/1994 Kroll et al.
5,410,852 A 5/1995 Edgar et al.
5,418,013 A 5/1995 Detrick et al.
5,439,518 A 8/1995 Francis et al.
5,481,843 A 1/1996 Kreikemeier
5,527,590 A 6/1996 Priluck
5,528,876 A 6/1996 Lu
5,529,192 A 6/1996 Conen et al.
5,540,023 A * 7/1996 Jaenson ..... E04F 13/04 52/343
5,570,953 A 11/1996 DeWall
5,590,505 A 1/1997 Bogle
5,592,800 A 1/1997 Koo et al.
5,605,024 A 2/1997 Sucato et al.
5,617,686 A 4/1997 Gallagher, Jr.
5,625,995 A 5/1997 Martin
5,685,116 A 11/1997 Bradshaw et al.
5,697,195 A 12/1997 Maylon
5,716,718 A 2/1998 Lai
5,732,520 A 3/1998 Maietta
5,753,036 A 5/1998 Hornaman et al.
5,755,545 A 5/1998 Banks
5,761,864 A 6/1998 Nonoshita
5,778,626 A 7/1998 Hellsten
5,826,388 A 10/1998 Irving
5,836,135 A 11/1998 Hagan et al.
5,842,276 A 12/1998 Asher et al.
5,845,379 A 12/1998 Steffensen
5,852,908 A 12/1998 Nankin
5,867,949 A 2/1999 Untiedt
5,867,962 A 2/1999 Scott et al.
5,927,035 A 7/1999 Haytayan
5,937,600 A 8/1999 Larson
5,943,775 A 8/1999 Lanahan et al.
5,979,131 A 11/1999 Remmele et al.
5,979,787 A 11/1999 Scarpa
6,035,595 A 3/2000 Anderson
6,047,510 A 4/2000 Gallaway
6,050,048 A 4/2000 Hellsten
6,052,959 A 4/2000 LaBrosse
6,108,991 A 8/2000 Hagan et al.
6,149,701 A 11/2000 Ellingson
6,205,740 B1 3/2001 Ekerholm et al.
6,207,256 B1 3/2001 Tashiro
6,254,981 B1 7/2001 Castle
6,263,629 B1 7/2001 Brown, Jr.
6,305,432 B1 10/2001 Sacks et al.
6,330,777 B1 * 12/2001 Padley ..... B21D 47/04 108/51.11
6,343,452 B1 2/2002 Holden
6,363,679 B1 4/2002 Rutherford
6,390,438 B1 5/2002 Mc Manus
6,412,249 B1 7/2002 Boyer et al.
6,447,928 B2 9/2002 Suitts
6,460,393 B1 10/2002 Sundhagen
6,481,175 B2 11/2002 Potter et al.
6,584,735 B2 7/2003 Burton
6,609,344 B2 8/2003 Saldana
6,617,386 B2 9/2003 Lelli et al.
6,658,809 B2 12/2003 Collins
6,668,501 B2 12/2003 Adebar et al.
6,754,997 B2 6/2004 Bonin
6,758,743 B1 7/2004 Grosskrueger
6,820,387 B2 11/2004 Sacks et al.
6,823,636 B2 11/2004 Mahoney
6,910,311 B2 6/2005 Lindberg et al.
6,920,734 B2 7/2005 Elderson
6,938,383 B2 9/2005 Morris et al.
6,993,883 B2 2/2006 Belanger
7,117,649 B2 10/2006 Morris et al.
7,143,551 B2 12/2006 Corwin
7,174,688 B2 2/2007 Higginbotham
7,179,165 B2 2/2007 Cook
7,195,556 B1 3/2007 Fichtelman
7,231,746 B2 6/2007 Bodnar
7,287,356 B2 10/2007 Sacks et al.
7,368,175 B2 5/2008 Neth
7,381,261 B1 6/2008 Nelson
7,497,903 B2 3/2009 Wang et al.
7,517,590 B2 4/2009 Wagner
7,538,152 B2 5/2009 Bohler et al.
7,565,775 B2 7/2009 Cooper et al.
7,604,534 B2 10/2009 Hill
7,654,051 B2 2/2010 Pollack
7,690,167 B2 4/2010 Antonic
7,735,294 B2 6/2010 Moody et al.
7,788,868 B2 9/2010 Pollack
7,820,302 B2 10/2010 Krettenauer
7,861,488 B2 1/2011 Giles et al.
7,866,112 B2 1/2011 Edmondson
7,921,537 B2 4/2011 Rodlin
7,955,460 B2 6/2011 Bennett, III et al.
8,074,416 B2 12/2011 Andrews
8,084,117 B2 12/2011 Lalvani
8,171,696 B2 5/2012 Powers, III et al.
8,225,581 B2 7/2012 Strickland et al.
8,234,836 B2 8/2012 Anderson
8,276,321 B2 10/2012 Bell
8,281,551 B2 10/2012 Leek et al.
8,578,576 B2 11/2013 Castricum
8,615,957 B1 12/2013 Sacks et al.
8,696,781 B2 4/2014 Wallner et al.
8,720,142 B2 5/2014 Spilchen
9,579,710 B2 * 2/2017 Ogden ..... E04C 5/04
2003/0029120 A1 * 2/2003 Sacks ..... E04C 5/04 52/660
2003/0029129 A1 2/2003 Walters
2003/0055147 A1 3/2003 Lelli et al.
2003/0126806 A1 7/2003 Ellis
2004/0000118 A1 1/2004 Fuerle
2004/0016176 A1 * 1/2004 Hadar ..... A01G 13/10 47/31
2004/0134158 A1 7/2004 Farrell, Jr. et al.
2005/0011156 A1 1/2005 Tseng
2005/0055949 A1 * 3/2005 Sacks ..... E04C 5/04 52/633
2005/0055953 A1 * 3/2005 Sacks ..... B21F 27/20 52/633
2005/0108978 A1 5/2005 Strickland et al.
2005/0115196 A1 * 6/2005 Raymundo ..... B21C 51/005 52/782.1
2005/0144901 A1 * 7/2005 Egan ..... D03D 1/00 52/782.1

(56) References Cited

U.S. PATENT DOCUMENTS

| | | | | |
|---|---|---|---|---|
| 2005/0257471 | A1* | 11/2005 | Stevens | E04B 5/02 52/443 |
| 2006/0075715 | A1 | 4/2006 | Serpico et al. | |
| 2006/0265997 | A1 | 11/2006 | Collins, Jr. et al. | |
| 2007/0072541 | A1 | 3/2007 | Daniels, II et al. | |
| 2007/0119106 | A1 | 5/2007 | Sacks et al. | |
| 2007/0175145 | A1* | 8/2007 | Sacks | B21F 27/20 52/408 |
| 2007/0193150 | A1 | 8/2007 | Carlson | |
| 2007/0243820 | A1 | 10/2007 | O'Hagin | |
| 2008/0148680 | A1* | 6/2008 | Jaenson | B21F 27/02 52/660 |
| 2008/0250738 | A1 | 10/2008 | Howchin | |
| 2009/0013633 | A1 | 1/2009 | Aubuchon | |
| 2009/0031656 | A1* | 2/2009 | Hunt-Hansen | E04F 13/04 52/344 |
| 2009/0186570 | A1 | 7/2009 | Riggins | |
| 2009/0203308 | A1 | 8/2009 | O'Hagin et al. | |
| 2010/0126097 | A1 | 5/2010 | Powers, III | |
| 2010/0229501 | A1 | 9/2010 | Bodnar | |
| 2010/0287872 | A1 | 11/2010 | Bodnar | |
| 2010/0300645 | A1 | 12/2010 | Glover | |
| 2011/0021663 | A1 | 1/2011 | Sacks et al. | |
| 2012/0028563 | A1 | 2/2012 | Sacks et al. | |
| 2012/0186190 | A1 | 7/2012 | Powers, III et al. | |
| 2012/0247047 | A1* | 10/2012 | Ogden | E04F 13/047 52/454 |
| 2012/0279162 | A1 | 11/2012 | Strickland et al. | |
| 2013/0333172 | A1 | 12/2013 | Wallner et al. | |
| 2014/0053495 | A1* | 2/2014 | Spilchen | B21D 47/00 52/664 |
| 2015/0240486 | A1 | 8/2015 | Sacks et al. | |
| 2015/0308118 | A1 | 10/2015 | Spilchen et al. | |
| 2015/0345150 | A1* | 12/2015 | Sacks | E04F 13/047 52/670 |

FOREIGN PATENT DOCUMENTS

| | | | |
|---|---|---|---|
| CH | 658 489 | A5 | 11/1986 |
| DE | 40 19 281 | A1 | 12/1991 |
| EP | 0 579 007 | A2 | 1/1994 |
| EP | 0 637 658 | A1 | 2/1995 |
| EP | 0 691 441 | A1 | 1/1996 |
| FR | 2 421 695 | A1 | 11/1979 |
| FR | 2584957 | | 7/1986 |
| GB | 311636 | A | 5/1929 |
| GB | 414277 | A | 8/1934 |
| GB | 2177730 | | 1/1987 |
| GB | 2 201 184 | A | 8/1988 |
| JP | 4-293848 | A | 10/1992 |
| JP | 7-233611 | A | 9/1995 |
| JP | 11-181989 | A | 7/1999 |
| JP | 2001-65140 | A | 3/2001 |
| JP | 2003-13577 | A | 1/2003 |
| WO | 00/53356 | A1 | 9/2000 |
| WO | 2010/059631 | A1 | 5/2010 |
| WO | 2012/024768 | A1 | 3/2012 |

OTHER PUBLICATIONS

"Expanded Metal Terminology," retrieved from http://www.expac.com/glossary.htm, retrieved on, May 6, 2014, 2 pages.

"HVAC Filter Industry," retrieved from http://www.expac.com/hvac.htm, retrieved on, May 6, 2014, 1 page.

"Standard Pattern Portfolio," retrieved from http://www.expac.com/standardportfolio.htm, retrieved on, May 6, 2014, 2 pages.

Andrade et al., "Lateral-torsional buckling of singly symmetric web-tapered thin-walled I-beams: 1D model vs. shell FEA," *Computers and Structures* 85:1343-1359, 2007.

Blomberg et al., "Heat Transmission Through Walls with Slotted Steel Studs," *Thermal Envelopes VII/Wall Systems—Principles*, pp. 621-628, 1998.

Demandit, "Interior/Exterior Acrylic Coating in Standard and Custom Colors," Dryvit Systems, Inc., 1990, 1 page.

Hoglund et al., "Slotted steel studs to reduce thermal bridges in insulated walls," *Thin-Walled Structures* 32:81-109, 1998.

International Search Report, for International Application No. PCT/US2010/050421, dated Feb. 9, 2011, 11 pages.

International Search Report, dated Sep. 30, 2016, for International Application No. PCT/CA2016/050900, 3pages.

Katz et al., "Handbook of Fillers for Plastics," 1987, pp. 441. (2 pages).

Metallic Demandit, "Interior/Exterior Acrylic Coating with a Metallic Appearance," Dryvit Systems, 1989, 1 page.

National Association of Architectural Metal Manufacturers, EMMA 557-99, "Standards for Expanded Metal," NAAMM, 1999, 18 pages.

Quarzite, "Exterior and Interior Quartz Aggregate Finish," Dryvit Systems, 1991, 1 page.

Sacks et al., "Energy Efficient Building Environmental Control Apparatus and Method," Office Action, dated Jul. 8, 2011, for U.S. Appl. No. 12/847,923, 17 pages.

Sacks et al., "Energy Efficient Building Environmental Control Apparatus and Method," Preliminary Amendment, filed Sep. 15, 2010, for U.S. Appl. No. 12/847,923, 11 pages.

Sacks et al., "Framing Members to Enhance Thermal Characteristics of Walls," Amendment filed Nov. 4, 2015, for U.S. Appl. No. 14/681,919, 20 pages.

Sacks et al., "Framing Members to Enhance Thermal Characteristics of Walls," U.S. Appl. No. 14/189,548, filed Feb. 25, 2014, 45 pages.

Sacks et al., "Framing Members to Enhance Thermal Characteristics of Walls," Office Action dated Oct. 9, 2014, for U.S. Appl. No. 14/189,548, 44 pages.

Sacks et al., "Framing Members to Enhance Thermal Characteristics Walls," U.S. Appl. No. 14/681,919, filed Apr. 8, 2015, 92 pages.

Sacks et al., "Framing Members to Enhance Thermal Characteristics of Walls," Office Action dated Aug. 4, 2015, for U.S. Appl. No. 14/681,919, 26 pages.

Sacks et al., "Framing Members to Enhance Thermal Characteristics of Walls," Office Action, dated Feb. 4, 2016, for U.S. Appl. No. 14/681,919, 19 pages.

Sacks et al., "Lath With Barrier Material," Amendment, filed Apr. 29, 2010, for U.S. Appl. No. 11/679,562, 4 pages.

Sacks et al., "Lath With Barrier Material," Office Action, dated Aug. 25, 2010, for U.S. Appl. No. 11/679,562, 12 pages.

Sacks et al., "Lath With Barrier Material," Office Action, dated Feb. 3, 2010, for U.S. Appl. No. 11/679,562, 15 pages.

Sacks et al., "Lath With Barrier Material," Supplemental Amendment, filed Jun. 15, 2010, for U.S. Appl. No. 11/679,562, 5 pages.

Sacks et al., "Light Weight Aggregate Composition," Office Action, dated Nov. 23, 2010, for U.S. Appl. No. 12/508,384, 8 pages.

Sacks et al., "Light-Weight Metal Stud and Method of Manufacture," Office Action dated May 14, 2013, for U.S. Appl. No. 13/767,764, 12 pages.

Sacks et al., "Light-Weight Metal Stud and Method of Manufacture," Amendment filed Aug. 7, 2013, for U.S. Appl. No. 13/767,764, 14 pages.

Sacks et al., "Light-Weight Metal Stud and Method of Manufacture," Notice of Allowance, dated Oct. 17, 2013, for U.S. Appl. No. 13/767,764, 21 pages.

Sacks et al., "Light-Weight Metal Stud and Method of Manufacture," U.S. Appl. No. 14/812,952, filed Jul. 29, 2015, 39 pages.

Sacks et al., "Light-Weight Metal Stud and Method of Manufacture," Office Action, dated Jan. 11, 2016, for U.S. Appl. No. 14/812,952, 14 pages.

Sacks et al., "Light-Weight Metal Stud and Method of Manufacture," Amendment, filed Apr. 8, 2016, for U.S. Appl. No. 14/812,952, 20 pages.

Sacks et al., "Light-Weight Metal Stud and Method of Manufacture," Office Action, dated May 2, 2016, for U.S. Appl. No. 14/812,952, 28 pages.

Sacks et al., "Twin Track Wire Lath," Amendment, filed Dec. 4, 2006, for U.S. Appl. No. 10/663,419, 22 pages.

(56) References Cited

OTHER PUBLICATIONS

Sacks et al., "Twin Track Wire Lath," Amendment, filed Jun. 18, 2007, for U.S. Appl. No. 10/663,419, 6 pages.
Sacks et al., "Twin Track Wire Lath," Amendment, filed Mar. 9, 2007, for U.S. Appl. No. 10/663,419, 10 pages.
Sacks et al., "Twin Track Wire Lath," Amendment, filed Nov. 12, 2005, for U.S. Appl. No. 10/663,419, 12 pages.
Sacks et al., "Twin Track Wire Lath," Amendment, filed Oct. 25, 2004, for U.S. Appl. No. 10/663,419, 14 pages.
Sacks et al., "Twin Track Wire Lath," Notice of Allowance, dated Jul. 26, 2007, for U.S. Appl. No. 10/663,419, 5 pages.
Sacks et al., "Twin Track Wire Lath," Office Action, dated Apr. 10, 2007, for U.S. Appl. No. 10/663,419, 9 pages.
Sacks et al., "Twin Track Wire Lath," Office Action, dated Feb. 9, 2007, for U.S. Appl. No. 10/663,419, 9 pages.
Sacks et al., "Twin Track Wire Lath," Office Action, dated Feb. 9, 2005, for U.S. Appl. No. 10/663,419, 10 pages.
Sacks et al., "Twin Track Wire Lath," Office Action, dated Jun. 7, 2004, for U.S. Appl. No. 10/663,419, 12 pages.
Sacks et al., "Twin Track Wire Lath," Office Action, dated Sep. 5, 2006, for U.S. Appl. No. 10/663,419, 15 pages.
Sacks et al., "Twin Track Wire Lath," Office Action, dated Sep. 12, 2005, for U.S. Appl. No. 10/663,419, 10 pages.
Sacks et al., "Twin Track Wire Lath," Supplemental Amendment, filed Nov. 17, 2005, for U.S. Appl. No. 10/663,419, 19 pages.
Spilchen et al., "Reinforcing Insert Article, Kit and Method," Amendment filed Dec. 18, 2015 for U.S. Appl. No. 14/795,731, 20 pages.
Spilchen et al., "Reinforcing Insert Article, Kit and Method," Office Action filed Sep. 18, 2015 for U.S. Appl. No. 14/795,731, 25 pages.
Spilchen et al., "Reinforcing Insert Article, Kit and Method," Office Action, dated Mar. 18, 2016, for U.S. Appl. No. 14/795,731, 17 pages.
Spilchen et al., "Reinforcing Insert Article, Kit and Method," U.S. Appl. No. 61/903,513, filed Nov. 13, 2013, 26 pages.
Wanner et al., "Expanded Metal and Process of Making the Same," U.S. Appl. No. 13/970,472, filed Aug. 19, 2013, 27 pages.
Wanner et al., "Expanded Metal and Process of Making the Same," Preliminary Amendment filed Oct. 16, 2013, for U.S. Appl. No. 13/970,472, 12 pages.

* cited by examiner

LATH DEVICE, ASSEMBLY AND METHOD

REFERENCE TO PENDING APPLICATIONS

This application does not claim the benefit of any pending U.S. Patent Application.

REFERENCE TO MICROFICHE APPENDIX

This application is not referenced in any microfiche appendix.

BACKGROUND OF THE INVENTION

Field of the Invention

The present invention is generally directed toward a metal lath, and more specifically, toward a metal lath for use with cementitious materials and having tension release devices on the lath.

Background

Cementitious materials, such as stucco, are prone to shrink during the curing period and are brittle and hence weak under tensile loads. The amount of shrinkage may vary depending on mix proportions, water content, and weather conditions.

This shrinkage induces tension within the cementitious material which may result in a myriad of cracks in the cementitious material. In order to prevent this cracking from occurring, the prior art teaches the use of a steel lath, or mesh, that provides high tensile strength to the cementitious material.

However, the stresses are cumulative and build up in the cementitious material as a wall area or wall length increases. The prior art laths, however, were made of high elongation steel wire, were stretchy laths such as woven wire netting, or packaged in sheets and not long rolls. These laths were forgiving and would allow cracking to occur before excessive buildup of the shrinkage stresses occurred.

Thus, there is a need for an improved metal lath used with cementitious material.

BRIEF SUMMARY OF THE INVENTION

The present invention satisfies the needs discussed above. The present invention is generally directed toward a metal lath, and more specifically, toward a metal lath for use with cementitious materials and having tension release devices thereon.

One aspect of the present invention which is directed toward a welded wire lath device includes a plurality of longitudinal wires extending along a plane and in a longitudinal direction. These longitudinal wires may be substantially parallel. A plurality of transverse wires extending along the plane in a transverse direction intersect with the longitudinal wires with each intersection point being welded together. These weld connections may be resistance weld connections.

Disposed on the longitudinal wires are a plurality of tension release devices that are randomly spaced along the plurality of parallel longitudinal wires. These tension release devices are in the form of a tension release device or indent and are intended to elongate when tension is placed on the longitudinal wires. This allows for a portion of cementitious material to be strengthened and in turn maintains the overall strength of the lath without stretching the underlying wire.

Further, by having the tension release devices being randomly spaced on the longitudinal wires, a straight line of weakness within the cementitious material is not created. This results in the reduction of large, long cracks forming in the cementitious material.

In another aspect of the present invention, the welded wire lath device as set out above also includes a plurality of collinear straight portions located along the longitudinal wires. These straight portions run between each tension release device in the plurality of tension release devices that are located on the longitudinal wires. These straight portions add an additional aspect of strength to the lath as they provide resistance to stress between the tension release devices.

In another aspect of the present invention, the longitudinal wires may have a circular cross-section and the tension release devices may be flattened and thus have a rectilinear cross-section. Further, the transverse wires as set out above have a circular cross-section.

In another aspect of the present invention, the welded wire lath device as set out above may also include a plurality of depressions disposed on the plurality of transverse wires. Each of these depressions have a depth and a length and extend in a depression direction perpendicular with respect to the plane.

The one aspect of the present invention which is directed toward a structural assembly for a structure, such as a wall or ceiling, including a structural support member base, a lath device as set out above attached to the structure and cementitious material, such as stucco cement plaster, embedded within the lath device.

Another aspect of the present invention which is directed toward a method of assembling a structural assembly including the steps of providing a lath device as set out above, fastening the lath device to a structure and applying cementitious material, such as a stucco cement plaster, to the lath.

The invention is not limited in its application to the details of the construction and arrangement of parts illustrated in the accompanying drawings. The invention is capable of other embodiments and of being practiced or carried out in a variety of ways. It is to be understood that the phraseology and terminology employed herein are for the purpose of description and not of limitation.

Upon reading the above description, various alternative embodiments will become obvious to those skilled in the art. These embodiments are to be considered within the scope and spirit of the subject invention, which is only to be limited by the claims which follow and their equivalents.

DESCRIPTION OF THE INVENTION

Figure 1:
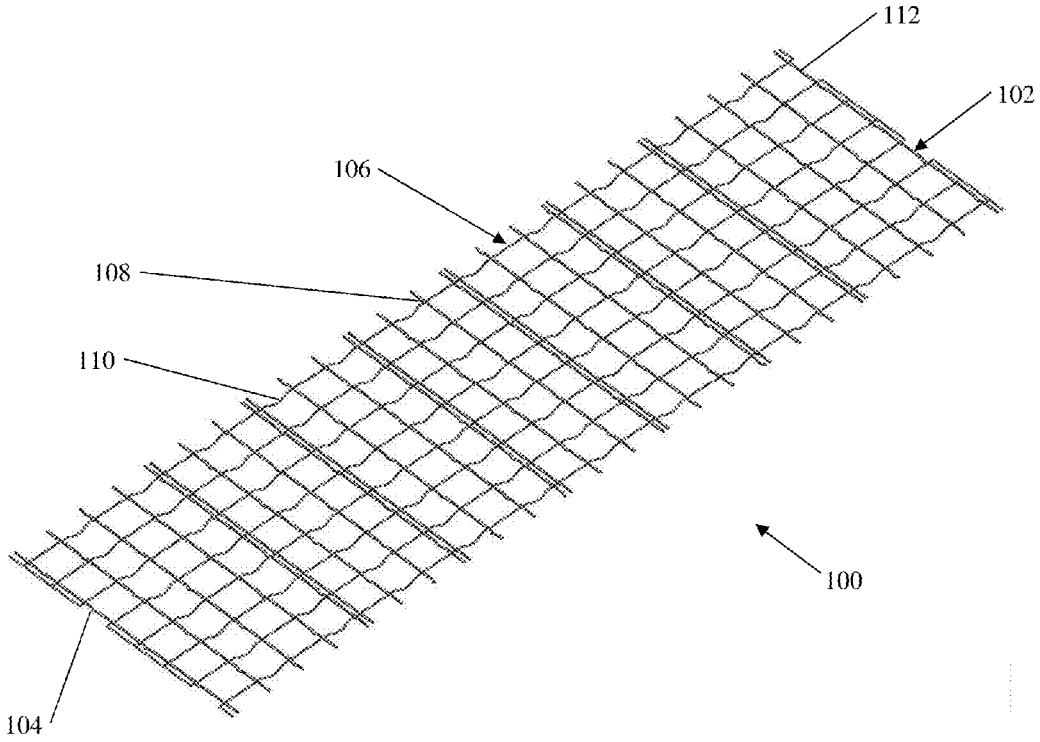
FIG. 1 is an isometric view of an embodiment of a welded wire lath device of the present invention.
Figure 2:
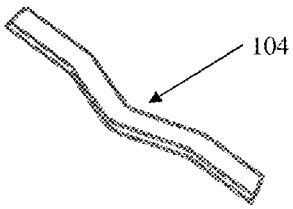
FIG. 2 is an isometric view of an embodiment of a tension release device of the present invention as shown in FIG. 1.
Figure 3:
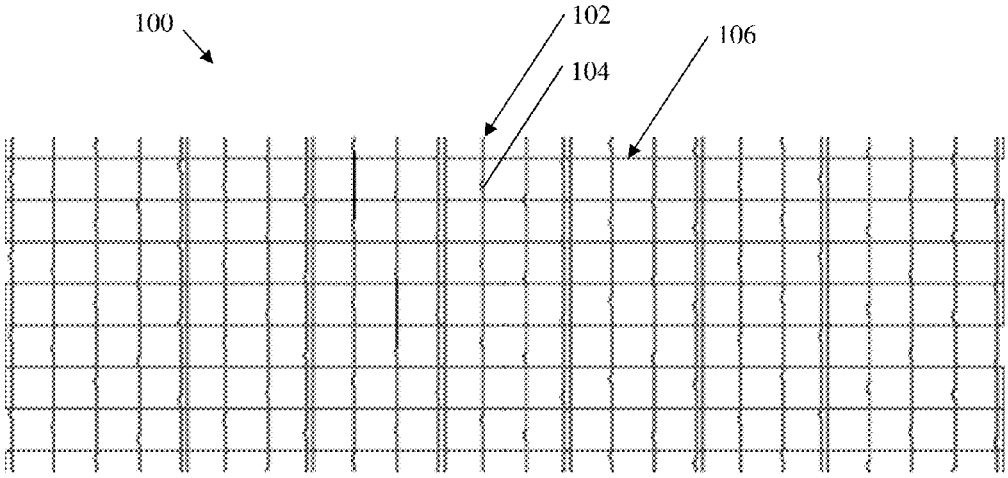
FIG. 3 is a top view of the embodiment of the present invention as shown in FIG. 1.
Figure 4:
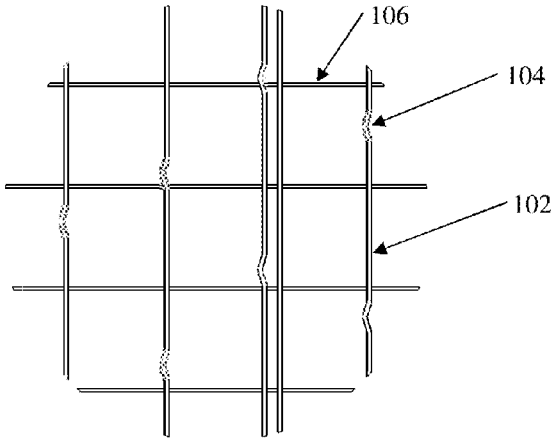
FIG. 4 is a close up view of the embodiment of the present invention as shown in FIG. 3.
Figure 5:
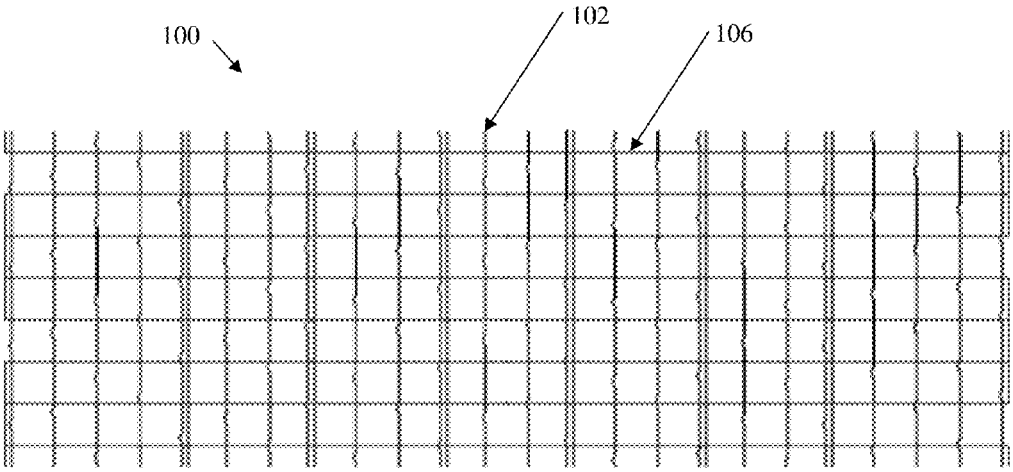
FIG. 5 is a bottom view of the embodiment of the present invention as shown in FIG. 1.
Figure 6:
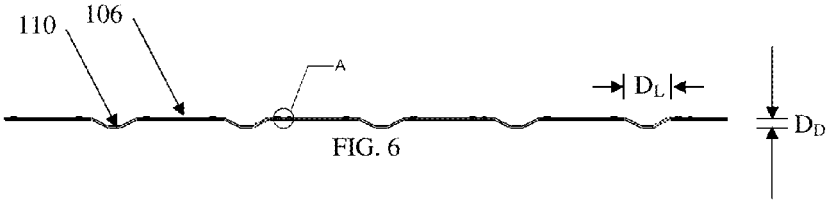
FIG. 6 is a front view of the embodiment of the present invention as shown in FIG. 1.
Figure 7:
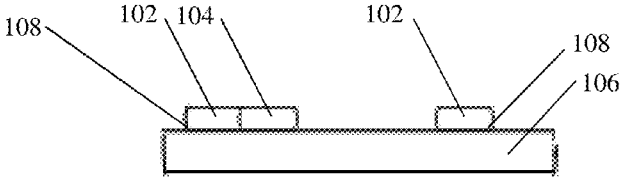
FIG. 7 is a close up view of portion A as shown in FIG. 6.
Figure 8:
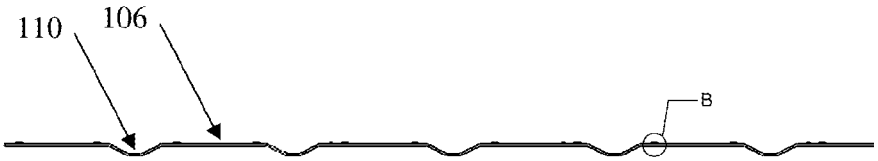
FIG. 8 is a back view of the embodiment of the present invention as shown in FIG. 1.
Figure 9:
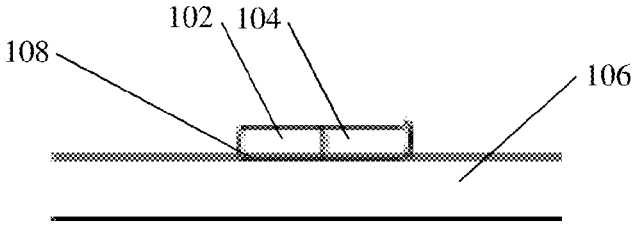
FIG. 9 is a close up view of portion B as shown in FIG. 8.

The present invention satisfies the needs discussed above. The present invention is generally directed toward a metal lath, and more specifically, toward a metal lath for use with cementitious materials and having tension release devices, such as crimps, thereon, a structural assembly with a metal lath embedded within it, and a method of assembling this structural assembly in a structure such as a wall.

FIGS. 1-10 illustrate an embodiment of the present invention with a welded wire lath device 100. Device 100 is used with a cementitious material, such as stucco, in order to provide additional strength to the cementitious material to prevent a destructive amount of cracking of the cementitious material.

In an embodiment, device 100 comprises a plurality of longitudinal wires 102 extending along a plane and in a longitudinal direction and a plurality of transverse wires 106 extending along the plane in a transverse direction. In this embodiment, the longitudinal wires 102 are substantially parallel to each other and the transverse wires 106 are also substantially parallel to each other. Further, the transverse wires 102 and longitudinal wires 106 may have a generally straight or sinusoidal shape. Additionally, at each point where the plurality of longitudinal wires 102 and the plurality of transverse wires 106 intersect, the wires are secured to one another by a weld connection 108. In an embodiment, the weld connections 108 are resistance weld connections.

As illustrated in FIG. 1, each of the plurality of transverse wires 106 has a plurality of depressions 110 disposed thereon. Each depression 110 extends in a depression direction perpendicular with respect to the plane and has a depression depth $D_D$ and depression length $D_L$ (see FIG. 6).

Figure 10:
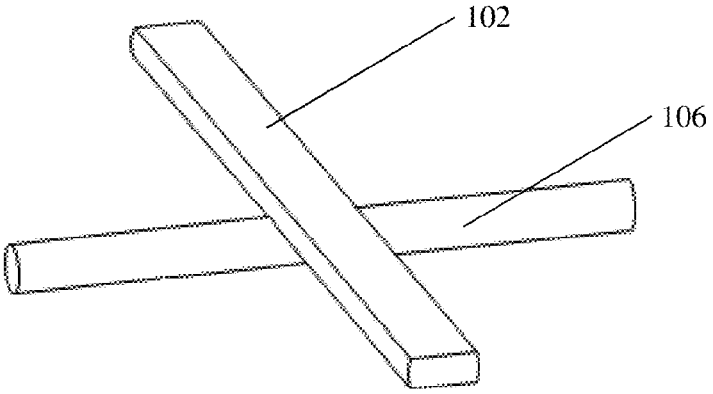
FIG. 10 is a close up isometric view of an intersection of the longitudinal and transverse wires of the embodiment of the present invention as shown in FIG. 1.
Figure 11:
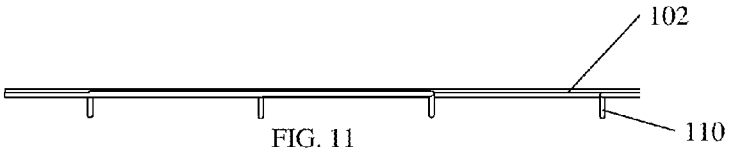
FIG. 11 is a side view of an embodiment of the transverse wire of the present invention.
Figure 12:
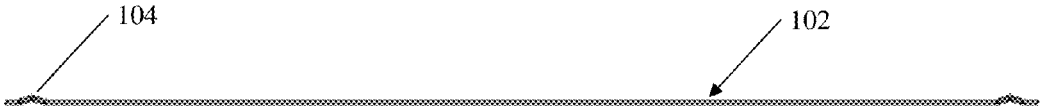
FIG. 12 is a side view of an additional embodiment of the longitudinal wire of the present invention.
Figure 13:
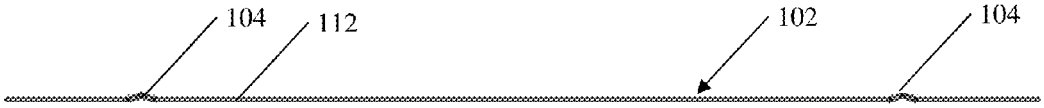
FIG. 13 is a side view of an additional embodiment of the longitudinal wire of the present invention.
Figure 14:
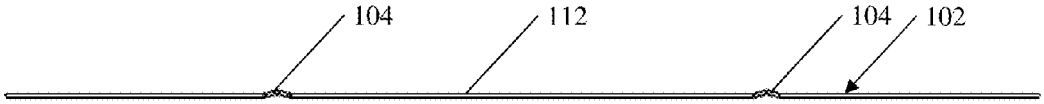
FIG. 14 is a side view of an additional embodiment of the longitudinal wire of the present invention.
Figure 15:
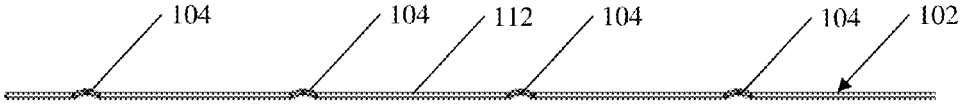
FIG. 15 is a side view of an additional embodiment of the longitudinal wire of the present invention.
Figure 16:
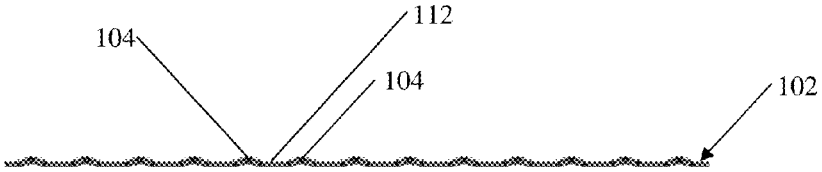
FIG. 16 is a side view of an additional embodiment of the longitudinal wire of the present invention.
Figure 17:
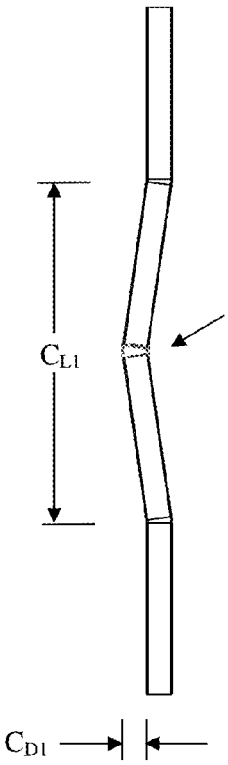
FIGS. 17-37 are side views of embodiments of tension release devices of the present invention.
Figure 18:
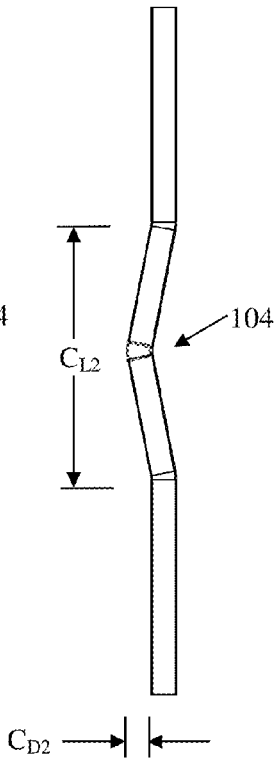
Figure 19:
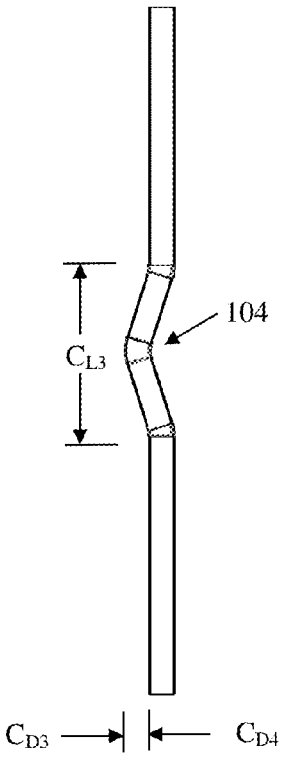
Figure 20:
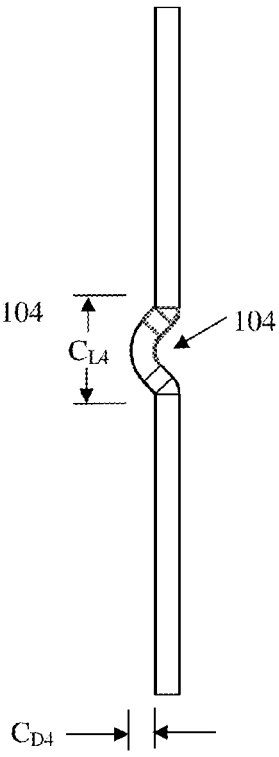
Figure 21:
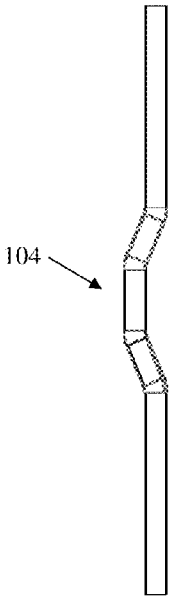
Figure 22:
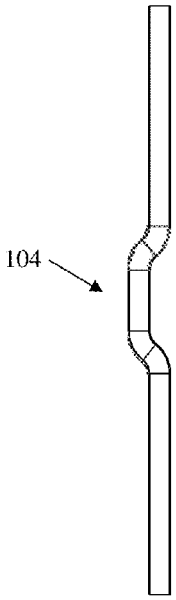
Figure 23:
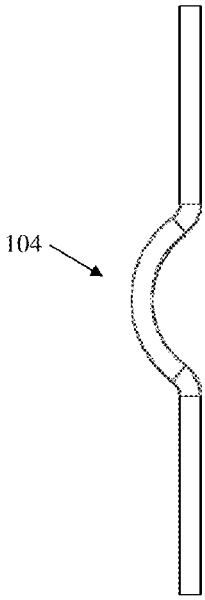
Figure 24:
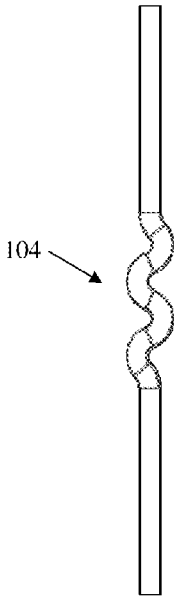
Figure 25:
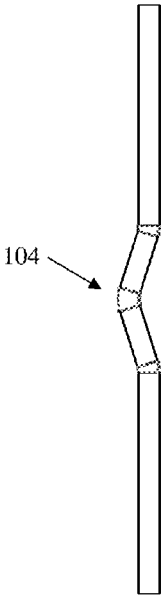
Figure 26:
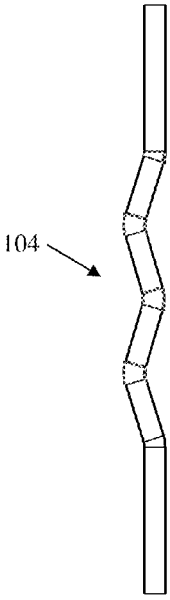
Figure 27:
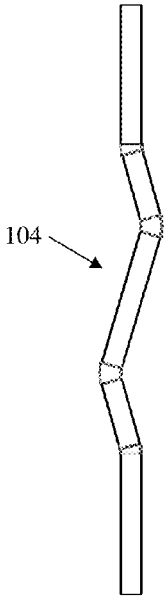
Figure 28:
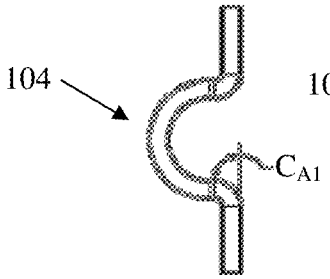
Figure 29:
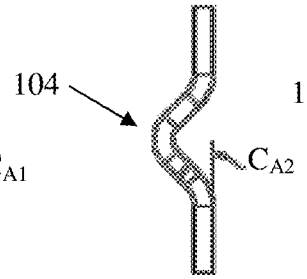
Figure 30:
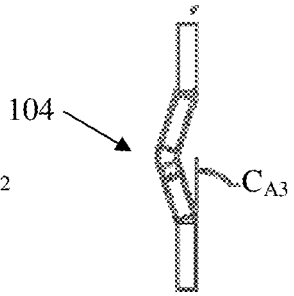
Figure 31:
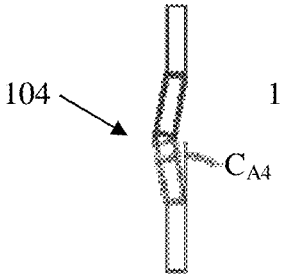
Figure 32:
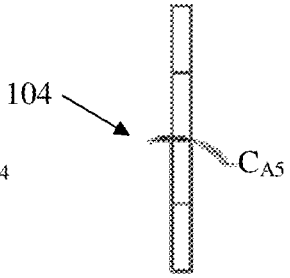
Figure 33:
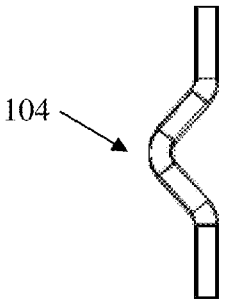
Figure 34:
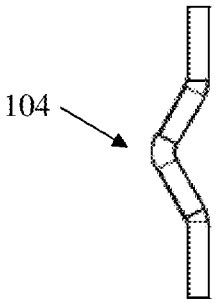
Figure 35:
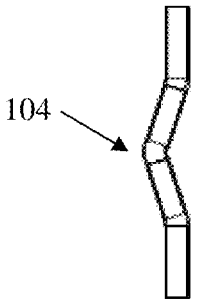
Figure 36:
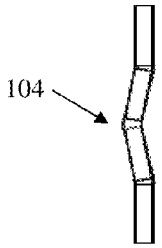
Figure 37:
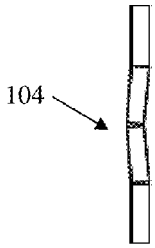

As illustrated in FIG. 10, in an embodiment, each of the plurality of longitudinal wires 102 has a rectilinear cross-section. This cross-section is formed by applying a flattening process to a round wire.

Disposed on at least one of the plurality of longitudinal wires 102 is at least one tension release device of a plurality of tension release devices 104. In this embodiment, the tension release device 104 is a crimp. The use of a crimp, however, is for illustrative purposes. Those skilled in the art will recognize that other tension release devices such an indent is also within the scope of the invention.

In this embodiment, one or more tension release devices 104 are randomly spaced along the plurality of longitudinal wires 102. When more than one tension release device 104 is placed on a single longitudinal wire 102, they are placed continuously and collinearly along the longitudinal wire 102. By placing the tension release devices 104 along each longitudinal wire 102, the device 100 is capable of elongating through the straightening of longitudinal wire 102 instead of stretching the wire. Tension release devices 104 allow device 100 to maintain its strength over time.

FIGS. 12-16 illustrate side views of additional embodiments of the longitudinal wire of the present invention. By placing tension release devices 104 randomly along longitudinal wire 102 (see FIGS. 12-16) a straight line of weakened portions within the cementitious material is not created. In this embodiment, each tension release device 104 may be spaced less than or equal to 96 inches away from each other tension release device 104 on the same longitudinal wire 102. Ideally, the spacing between tension release devices 104 may be between 3 to 4 inches. This will provide adequate weakening in high stress zones to allow minor cracking and ultimately stucco stress relief, while preventing major cracking that will damage the stucco. These lengths are illustrated and not meant to be limiting. Further, in an embodiment each tension release device 104 has a rectilinear cross-section as each tension release device is created into each horizontal wire 102 prior to the flattening process that flattens the horizontal wires 102.

Additionally, as illustrated in FIGS. 17-37, each tension release device 104 has a tension release device depth $C_{D1\text{-}4}$ (see FIGS. 17-20), a tension release device length $C_{L1\text{-}4}$ (see FIGS. 17-20), and a tension release device angle $C_{A1\text{-}5}$ (see FIGS. 28-32). In an embodiment, the tension release device depth is at least 0.02 inches, a tension release device length less than or equal to 1 inch, and a tension release device angle less than 90 degrees. Optimally, tension release device depth of approximately 0.060 to 0.070 inch in depth provide the desired performance in achieving some improved elongation characteristics while retaining strength. The use of these measurements is illustrative and is not meant to be limiting. In this embodiment, each tension release device 104 extends in the same direction along the plane. However, this is illustrative and not meant to be limiting. Those skilled in the art can recognize the tension release devices 104 can extend in multiple directions along the plane.

Located along the plurality of longitudinal wires 102 and between the plurality of tension release devices 104 are a plurality of collinear straight portions 112. In an embodiment where the tension release devices 104 are randomly spaced along the longitudinal wires 102, the straight portions 112 are also randomly spaced along the longitudinal wires 102. Straight portions 112 provide additional strength to resist stress between the tension release devices 104.

Illustrated on FIGS. 17-37 are side views of various embodiments of horizontal wire 102 with various tension release device shapes.

Figure 38:
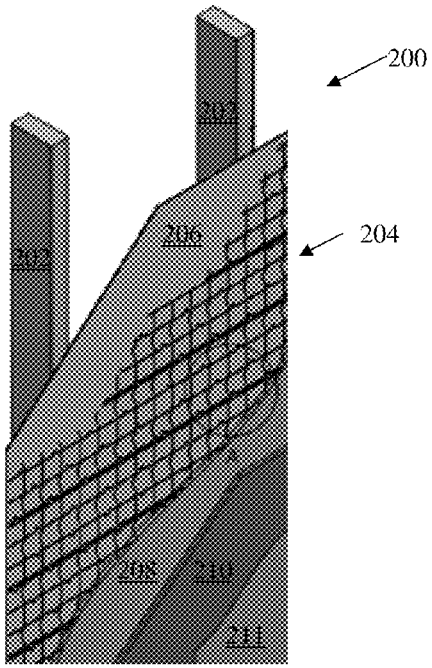
FIG. 38 is an isometric view of an embodiment of an assembly of the present invention.
Figure 39:
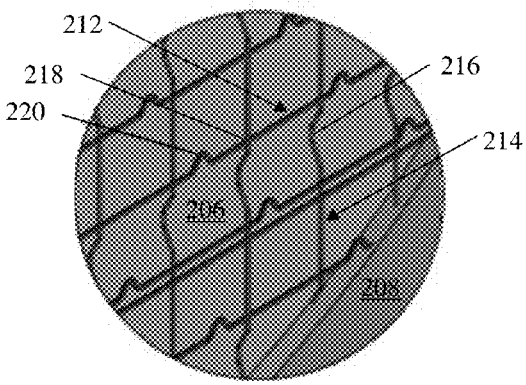
FIG. 39 is a close up view of portion A as shown in FIG. 38.

FIGS. 38-39 illustrate an embodiment of the present invention with a structural assembly for a structure 200. Structure 200 is used in the construction of walls, ceilings, and the like. Structure 200 comprises a structural support member base 202, a lath device 204 which is attached to structural support member base 202, and cementitious material 206, such as stucco, is embedded within lath device 204.

Lath device 204 comprises a plurality of longitudinal wires 212 extending along a plane and in a longitudinal direction and a plurality of transverse wires 214 extending along the plane in a transverse direction. A plurality of depressions 216 is disposed on each transverse wire 214. At each intersection where the plurality of longitudinal wires 212 and the plurality of transverse wires 214 intersect are secured by a weld connection 218. In this embodiment, the plurality of weld connections 218 comprises resistance weld connections. Disposed on the plurality of longitudinal wires 212 are a plurality of tension release devices 220 randomly spaced along the plurality of longitudinal wires 212.

In this embodiment, the stucco 206 comprises a scratch coat 208, a browned coat 210, and a finished coat 211. This is illustrative and not meant to be limiting. Those skilled in the art recognize other cementitious materials with different coats are within the scope of the present invention. Alternatively, the stucco 206 may comprise a scratch coat 208, a browned coat 210, a finished coat 211, or a combination thereof.

Figure 40:
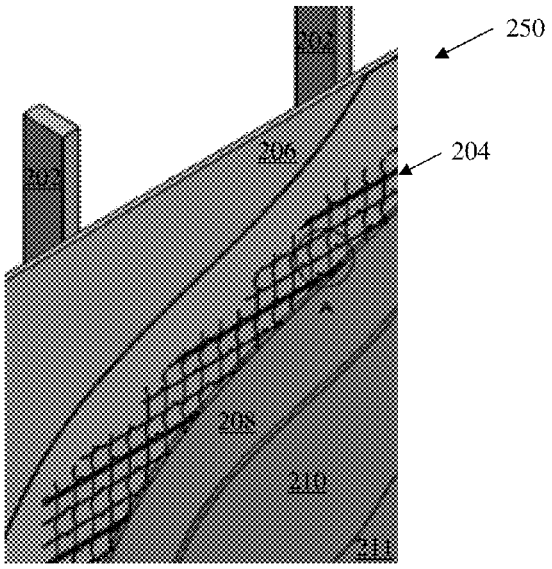
FIG. 40 is an isometric view of an additional embodiment of an assembly of the present invention.
Figure 41:
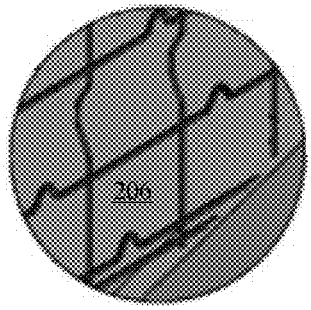
FIG. 41 is a close up view of portion A as shown in FIG. 39.

FIGS. 40-41 illustrate another embodiment the present invention wherein a structural assembly for a structure 250 is shown. Structure 250 is similar to structure 200 except structure 250 is utilizing a sheathed frame.

Figure 42:
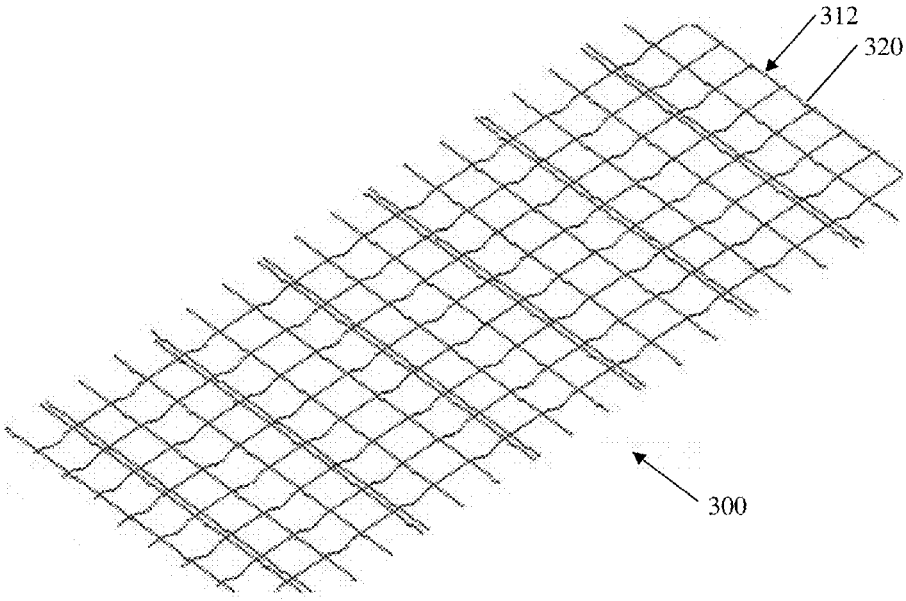
FIG. 42 is an isometric view of an additional embodiment of a welded wire lath device of the present invention.
Figure 43:
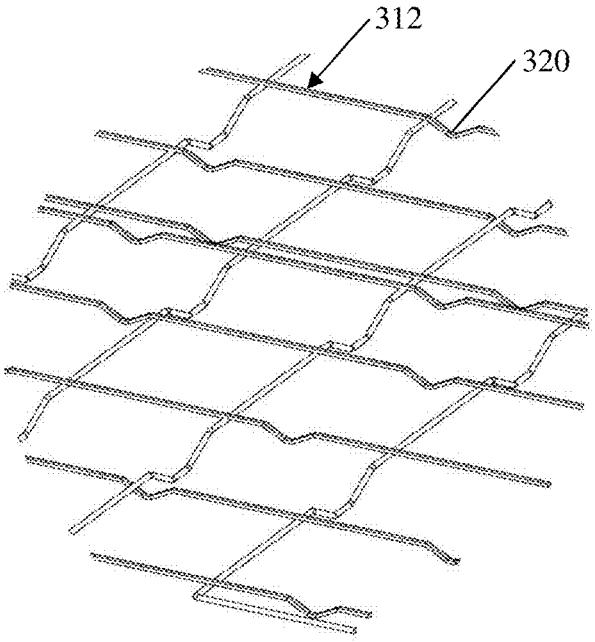
FIG. 43 is a close up view of the embodiment of the present invention as shown in FIG. 42.

FIG. 42 illustrate another embodiment 300 of the present invention wherein the plurality of tension release devices 320 are randomly spaced along the plurality of longitudinal wires 312 but in a direction that is out of the plane of longitudinal wires 312. FIG. 43 is a close up view of the embodiment of the present invention as shown in FIG. 42.

Another embodiment of the present invention is directed toward a method of assembling a structural assembly in a structure. In this embodiment, the method comprises providing a lath device, fastening the lath device as previously described to the structure; and applying a cementitious material, such as stucco, to the lath device. The application of the stucco may be manually or mechanically applied to the lath.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification.

LIST OF FEATURES AND REFERENCE NUMERALS

100 device
102 longitudinal wires
106 transverse wires
108 weld connections
110 depression
112 collinear straight portions
200 structure
202 structural support member base
204 lath device
206 cementitious material
212 longitudinal wires
214 transverse wires
218 weld connection
220 tension release devices
208 scratch coat
210 browned coat
211 finished coat
250 structure
300 device
320 tension release devices
312 longitudinal wires

The invention claimed is:

1. A welded wire lath, comprising:

a plurality of longitudinal wires, wherein each of the plurality of longitudinal wires extends in a first direction;

a plurality of tension release features positioned within each of the plurality of longitudinal wires, wherein each of the tension release features includes at least one first angular portion, and wherein the tension release features are arranged within the longitudinal wires so that the tension release features do not form a straight line of tension release features that extends across the welded wire lath transverse to the first direction;

a plurality of transverse wires, wherein each of the plurality of transverse wires extends in a second direction that is transverse to the first direction;

a plurality of depressions positioned within each of the plurality of transverse wires, wherein each of the depressions includes at least one second angular portion; and a plurality of weld connections that couple the plurality of longitudinal wires to the plurality of transverse wires.

2. The welded wire lath of claim 1, wherein each of the plurality of longitudinal wires extends within a first plane and each of the plurality of transverse wires extends within a second plane that is parallel to the first plane.

3. The device welded wire lath of claim 1 wherein each depression extends in a third direction that is transverse to the first and second directions.

4. The welded wire lath of claim 1, wherein the plurality of tension release devices features are randomly spaced along the respective longitudinal wires.

5. The welded wire lath of claim 1, wherein the plurality of tension release features of at least one of the longitudinal wires are disposed collinearly along the at least one of the longitudinal wires.

6. The welded wire lath of claim 1, wherein each tension release feature of the plurality of tension release features is spaced less than or equal to 96 inches away from each other tension release feature of the plurality of tension release features on the same longitudinal wire.

7. The welded wire lath of claim 1, wherein each of the plurality of the longitudinal wires are substantially parallel.

8. The welded wire lath of claim 1, wherein each of the plurality of the transverse wires are substantially parallel.

9. The welded wire lath of claim 1, wherein the plurality of weld connections comprises resistance weld connections.

10. The welded wire lath of claim 1, wherein each of the plurality of longitudinal wires, including each of the plurality of tension release features therein, has a rectilinear cross-sectional shape.

11. The welded wire lath of claim 1, wherein each of the plurality of transverse wires has a circular cross-sectional shape.

12. The welded wire lath of claim 1, wherein each tension release feature of the plurality of tension release features comprises:

a tension release depth of at least 0.02 inches, and a tension release length of less than or equal to 1 inch.

13. The welded wire lath of claim 1, wherein each of the plurality of longitudinal wires comprises a plurality of collinear straight portions.

14. The welded wire lath of claim 1, wherein each of the plurality of longitudinal wires has a sinusoidal shape.

15. The welded wire lath of claim 1, wherein each of the plurality of longitudinal wires extends within a first plane and each tension release feature of the plurality of tension release features extends in a third direction within the first plane.

16. The welded wire lath of claim 1, wherein each of the plurality of longitudinal wires extends within a first plane and the plurality of tension release features comprises tension release features that extend in different directions with respect to the first plane.

17. The welded wire lath of claim 1, wherein each of the longitudinal wires comprises a plurality of collinear straight portions, wherein the plurality of tension release features are randomly spaced along the plurality of longitudinal wires, and wherein each longitudinal wire, including each of the plurality of tension release features and each of the collinear straight portions therein, has a rectilinear cross-sectional shape.

18. A structural assembly, comprising:

a structural support member base, a welded wire lath attached to the structural support member base, the welded wire lath comprising:

a plurality of longitudinal wires, wherein each of the plurality of longitudinal wires extends in a first direction, a plurality of tension release features positioned within each of the plurality of longitudinal wires, wherein each of the tension release features includes at least one first angular portion, and wherein the tension release features are arranged within the longitudinal wires so that the tension release features do not form a straight line of tension release features that extends across the welded wire lath transverse to the first direction, a plurality of transverse wires, wherein each of the plurality of transverse wires extends in a second direction that is transverse to the first direction;

a plurality of depressions positioned within each of the plurality of transverse wires, wherein each of the depressions includes at least one second angular portion, and a plurality of weld connections that couple the plurality of longitudinal wires to the plurality of transverse wires, and cementitious material attached to the welded wire lath.

19. The assembly of claim 18, wherein the cementitious material is stucco.

20. The assembly of claim 19, wherein the stucco comprises a coat is selected from the group consisting of a scratch coat, a browned coat, a finished coat and a combination of thereof.

21. The welded wire lath of claim 1 wherein the tension release devices are equally spaced apart from one another along lengths of the longitudinal wires.

22. The welded wire lath of claim 21 wherein the longitudinal wires, including the respective tension release devices, are staggered with respect to one another.

23. The welded wire lath of claim 21 wherein the longitudinal wires, including the respective tension release devices, are randomly staggered with respect to one another.

24. The welded wire lath of claim 1 wherein the plurality of tension release features include a plurality of crimps.

25. The welded wire lath of claim 1 wherein the plurality of tension release features include a plurality of indents.

26. A welded wire lath, comprising:

a plurality of longitudinal wires including a first longitudinal wire that includes a first plurality of tension release portions, a second longitudinal wire that includes a second plurality of tension release portions, and a third longitudinal wire that includes a third plurality of tension release portions, wherein each of the longitudinal wires extends in a first direction;

a plurality of transverse wires, wherein each of the transverse wires extends in a second direction that is transverse to the first direction; and a plurality of weld connections that couple the plurality of longitudinal wires to the plurality of transverse wires;

wherein the tension release portions are arranged so that no subset of the tension release portions that includes at least one tension release portion from each of the first, second, and third pluralities of tension release portions forms a straight line that extends across the welded wire lath transverse to the first direction.

27. The welded wire lath of claim 26 wherein the first plurality of tension release portions are randomly spaced along the first longitudinal wire, the second plurality of tension release portions are randomly spaced along the second longitudinal wire, and the third plurality of tension release portions are randomly spaced along the third longitudinal wire.

28. The welded wire lath of claim 26 wherein the first plurality of tension release portions are equally spaced along the first longitudinal wire, the second plurality of tension release portions are equally spaced along the second longitudinal wire, and the third plurality of tension release portions are equally spaced along the third longitudinal wire, and the first, second, and third longitudinal wires are randomly staggered with respect to one another.

* * * * *